United States Patent [19]

Alt

[11] Patent Number: 4,766,810

[45] Date of Patent: Aug. 30, 1988

[54] SHEET FEEDER FOR PRINTING BOUND SHEETS

[75] Inventor: Karl-Heinz Alt, Schwabmunchen, Fed. Rep. of Germany

[73] Assignee: Print-Collect GmbH, Fed. Rep. of Germany

[21] Appl. No.: 50,335

[22] Filed: May 18, 1987

[30] Foreign Application Priority Data

May 24, 1986 [DE] Fed. Rep. of Germany ..... 3617597

[51] Int. Cl.[4] ..... B41F 17/02

[52] U.S. Cl. ..... 101/217; 101/35; 101/240; 271/1

[58] Field of Search ..... 101/35, 212, 216, 217, 101/232, 240; 271/1

[56] References Cited

U.S. PATENT DOCUMENTS 1,764,828 6/1930 Cotton ..... 101/35 X

FOREIGN PATENT DOCUMENTS 53331 3/1984 Japan ..... 271/1

*Primary Examiner*—Clifford D. Crowder

*Attorney, Agent, or Firm*—Sixbey, Friedman, Leedom & Ferguson

[57] ABSTRACT

A sheet feeder for use with an offset printing device that is capable of feeding sheets that are bound together along a common edge is disclosed herein. The sheet feeder generally comprises a stack holder for holding a stack of bound sheets along their commonly bound edges, an endless conveyor formed from parallel chains that are driven between the top of the bound sheets and the impression cylinder of the offset printing device, a set of driving and pressure rollers connected between the parallel chains of the conveyor and rotating with it, and a suction gripper movable perpendicularly with respect to the sheet stack top for lifting the respective topmost sheet. In operation, the suction gripper lifts a sheet, and then one of the driving and pressure rollers slides under the sheet and carries it to the impression cylinder, whereupon it acts as a pressure roller during the printing process. After the sheet is printed, the driving and pressure roller automatically turns the sheet off of the stack so that the process can be repeated.

6 Claims, 4 Drawing Sheets

SHEET FEEDER FOR PRINTING BOUND SHEETS

BACKGROUND OF THE INVENTION

This invention relates to a sheet feeder for use with a printing device for printing a stack of sheets already bound along a common edge.

There are times when it becomes necessary to print onto a stack of sheets that have already been bound together along one edge in a book-like or pamphlet form. Take, for example, the case of annual calendars of the type sold to businesses who wish to distribute them for advertising purposes. The suppliers of such calendars often print up and bind together the individual monthly calendars, leaving space on the sheets for advertisements to be printed. Once the calendar manufacturer knows which ads to print onto the spaces provided on the individual calendar sheets, each sheet must be turned over individually and fed to a printing press to print the ad, which in a manual operation is a time-consuming and tiresome job.

The object of the invention therefore is to provide an automated, fully mechanized sheet feeder for performing such printing work, i.e., which is able individually to lift the individual sheets of a stack bound to one another on one edge (of a stitched or otherwise bound pad or the like), feed them to the printing device and turn them over in the course of this operation.

SUMMARY OF THE INVENTION

In the sheet feeder of the invention, the sheet is lifted in each case individually by the lifting element which is preferably a suction gripper, and is engaged by a driving and pressure roller mounted on an endless conveyor. This roller slides underneath the lifted paper and engages it against the impression cylinder of the printing unit, thereby acting as a pressure roller with the impression cylinder during the printing process. In leaving the nip between the impression cylinder and pressure roller, the printed sheet moves into a turned-over position in relation to the original stack because of the relationship between the impression cylinder, the rotational path of the driving and pressure rollers, and the stack holder. This process is repeated until all the sheets of the stack are provided with the desired impression.

The driving and pressure rollers connected to the endless conveyor can be guided by a forced guidance (such as a track) which in the area of the impression cylinder defines a circular segment parallel to the impression cylinder periphery. Such forced guidance guarantees cooperation between the pressure roller and the impression cylinder during the printing operation.

The stack holder need not grip only an individual bound sheet stack or pad in each case but can, of course, grip a larger stack made up of several individual stacks or pads. In such a case it is also possible to operate the device so that certain sheets of each individual stack or pad, for example the cover sheets of annual calendars, remain unprinted. In this case, the sheet feeder can also have a turnover element which grips the respective individual sheets after they are lifted by the suction gripper and immediately turns them over, thereby bypassing the printing process by preventing this sheet from being carried by the driving and pressure roller and engaged against the impression cylinder. This turnover element can be actuated during an interruption cycle of the endless conveyor so that no driving or pressure roller goes into action. Alternatively, the turnover element can be operated so fast that the driving and pressure roller does not go into operation against the selected sheet. This last mode of operation advantageously obviates the need for interrupting the rotation of the endless conveyor.

Finally, the stack holder can be designed as a part of an automatic stack feed mechanism which in each case automatically grips and feeds the successive stacks of sheets bound to one another, for example individual calendar pads, as soon as the previous stack or calendar pad is completely printed. Such an automatic stack feeding mechanism may utilize at least two stack holders which are used alternately, one holding the stack or pad to be printed at the moment, while the other ejects the previously completely printed stack or pad and grips the next stack or pad.

The type of printing process used, the arrangement and size of the impression cylinder, the question of single color or multicolor printing are of no importance for the operation of a sheet feeder according to the invention.

An embodiment of the invention is briefly described below with reference to the accompanying drawings. The drawings first show in diagrammatic perspective representation a sheet feeder according to the invention together with a printing unit. The drawings then show in diagrammatic form this device int three different operating positions to facilitate an understanding of the operation of the invention.

BRIEF DESCRIPTION OF THE SEVERAL FIGURES

DETAILED DESCRIPTION OF THE PREFERRED EMBODIMENT

Figure 1:
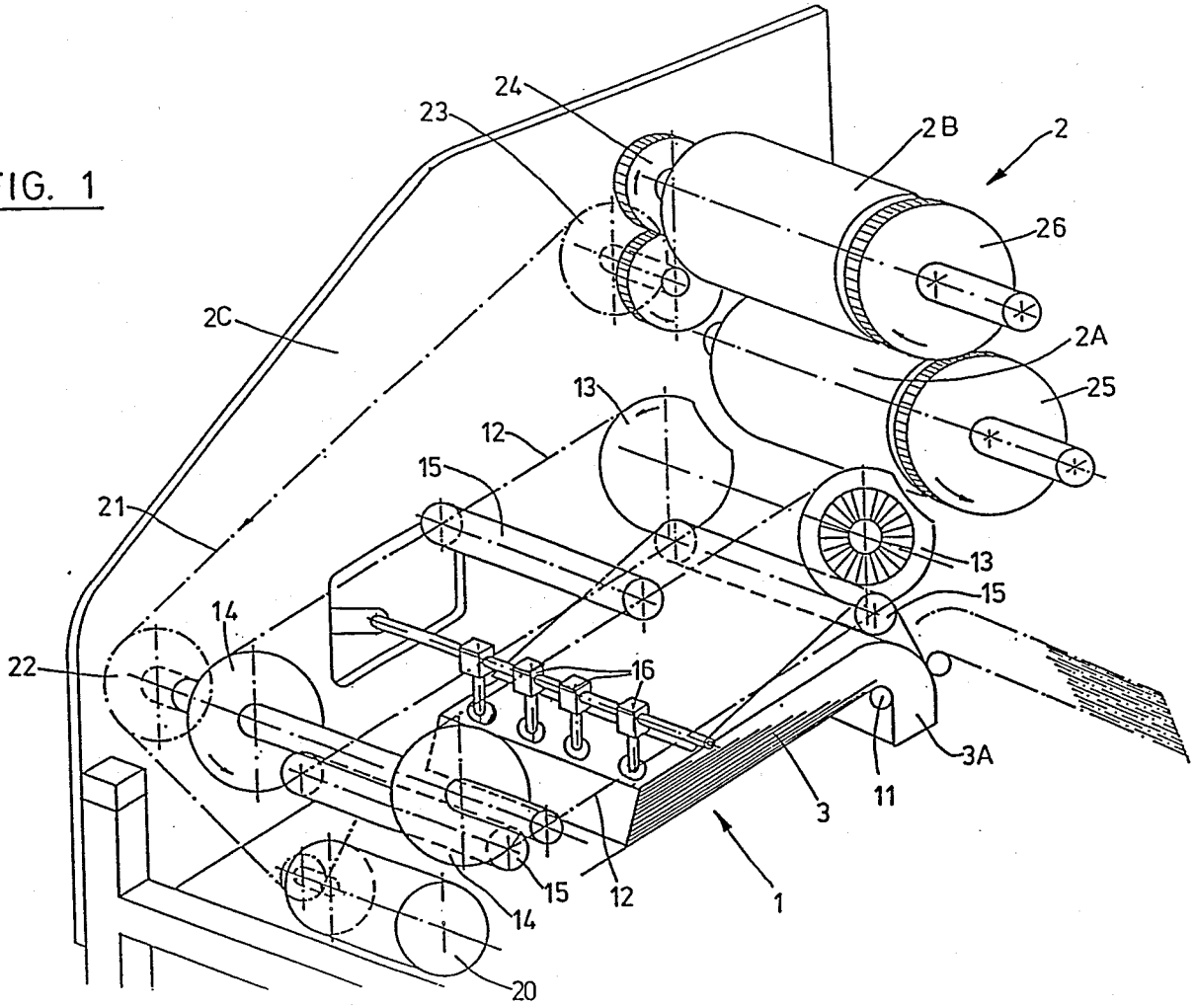
FIG. 1 illustrates the sheet feeder in diagrammatic perspective form.

FIG. 1 is a partially schematic perspective view of a sheet feeder 1 in connection with a printing device 2 for production of impressions on the indivdiual sheets of a sheet stack 3 bound along one edge. Printing device 2 can be an offset printing unit which includes an impression cylinder 2A that is designed as a blanket-transfer cylinder, and a form cylinder 2B that is designed as a plate cylinder. Plate cylinder 2B receives printing ink from a usual inking device (not shown) and transfers the image to the blanket of impression cylinder 2A, which retransfers it to the paper sheets. The two cylinders 2A and 2B are rotatably mounted in a frame 2C and are driven by a driving motor 20 by a chain drive. This chain driver is formed from a drive chain 21 and sprocket wheels 22 and 23 and by a gearing 24, with gear 24 driving plate cylinder 2B. To the two cylinders 2A and 2B are connected gears 25 and 26 which mesh with one another, so that impression cylinder 2A is driven by the plate cylinder 2B and the two cylinders rotate in opposite directions.

A sheet feeder 1, also placed in frame 2C, is provided for the printing unit 2. This feeder 1 includes the following components: a stack holder 11 for holding a stack of sheets 3 along the side 3A where the sheets are bound (with the stack being formed, for example, by an individual pad or by a multiplicity of stacked pads); an endless conveyor formed from a pair of chains 12 which are placed on both sides of sheet stack 3, such chains being guided by two sprocket wheel pairs 13 and 14; a number of driving and pressure rollers 15 placed uniformly around the conveyor chain pair 12 and rotating together with the conveyor element, each of said rollers 15 extending between the two conveyor chains 12 and being fastened at their two ends to these conveyor chains 12, and finally a suction gripper 16 which can include either a number of individual suction heads, as represented, or a suction rod extending over the entire sheet width.

Sprocket wheel pair 14 is rotatably mounted onto a common shaft with sprocket wheel 22, which is driven by chain 21. Chain 21 also drives the plate cylinder 2B and impression cylinder 2A so that the driving motor 20, through drive chain 21 and sprocket wheel 22 (with the sprocket wheel pair 14 thus coupled) drives the endless conveyor through sprocket wheel pair 14 and the driving and pressure rollers 15 connected thereto so that the conveyor travels in synchronization with cylinder pair 2A and 2B.

Stack holder 11 is preferably a clamping device for clamping the stack of bound sheets to be printed. When the endless conveyor is formed from two conveyor chains 12, the lower segment of the chains 12 is driven past the top of the still unprinted sheet stack 3 as well as the impression cylinder 2A of printing unit 2. Of course, conveyor chain pair 12 can also be driven by more than two sprocket wheel pairs in suitable arrangement and dimension. Conveyor chains 12 are indicated only by dot-dash lines in their rotational path, which at the same time forms the rotational path of driving and pressure rollers 15. In the area of the impression cylinder 2A, the shape of this rotational path is in the form of a circular segment that extends parallel to the impression cylinder periphery. In this area a structure for guiding the driving and pressure rollers 15 is provided (which is not represented for better clarity of the drawing) which may for example be formed from appropriately running guide grooves or guide rails placed in frame 2C. The guiding arrangement can be made so that the driving and pressure rollers 15 that are connected across the two conveyor chains 12 can laterally roll along the periphery of impression cylinder 2A between the sprocket wheel 13. In an alternate embodiment sprocket wheel pair 13 could be replaced with an upper and lower sprocket wheel pair with smaller diameter sprocket wheels in each case, in which case the circular segment of the rotational path of rollers 15 that is parallel to the impression cylinder 2A is formed by a free chain strand running between these two sprocket wheel pairs which provides forced guidance for rollers 15 in this area. The conveyor element, namely conveyor chain pair 12 itself, does not have to follow the circular segment of rollers 15 exactly as provided by the forced guidance if a corresponding relative lateral mobility is provided for the rollers 15 in relation to the chain links.

Suction gripper 16 in relation to the rotational movement of the endless conveyor is stationary but may move perpendicularly relative to the top of sheet stack 3. It may either be moved straight up or placed on a pivot arm to lift the topmost sheet of sheet stack 3 by use of partial vacuum.

Figure 2:
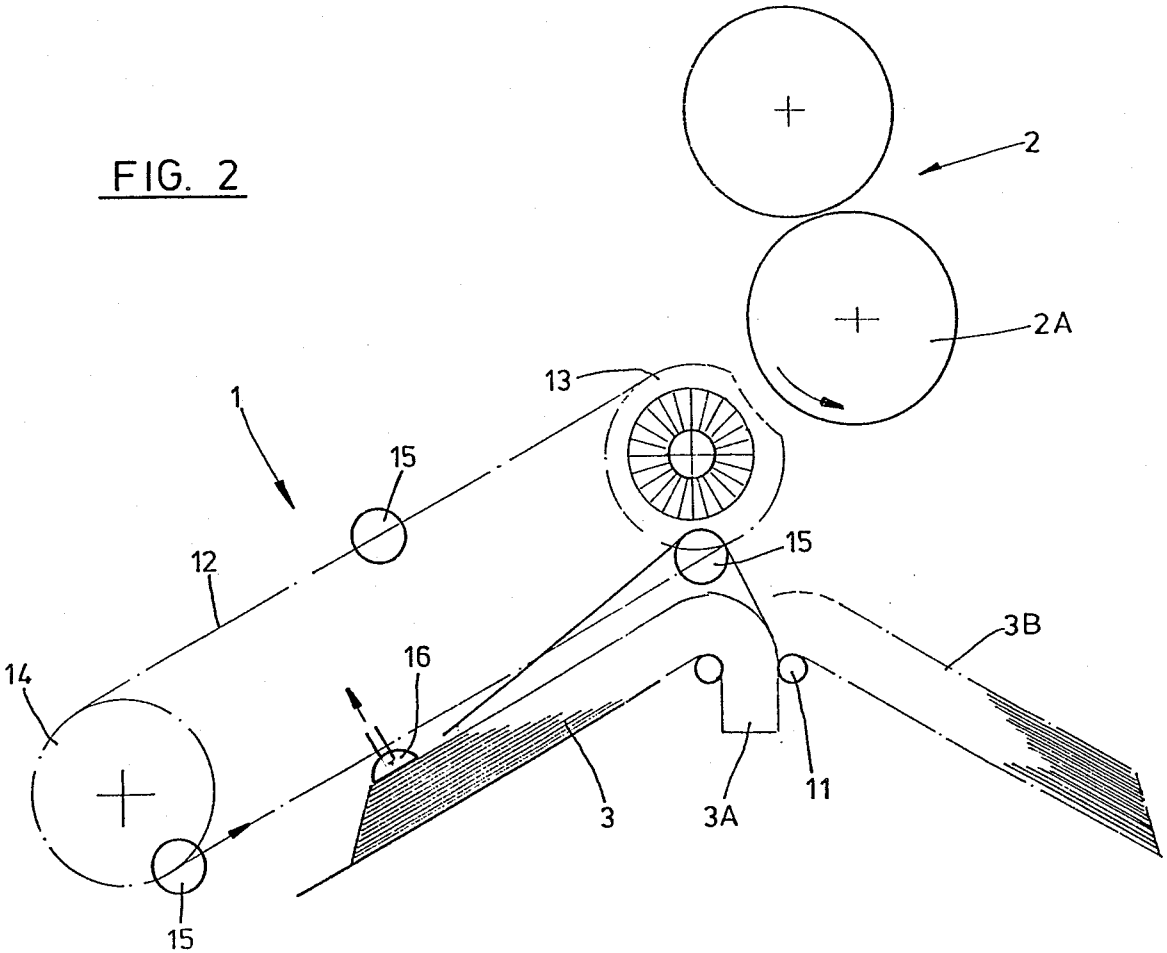
FIG. 2 illustrates the sheet feeder lifting an individual sheet of the stack at the same time feeding the previous sheet to the impression cylinder.
Figure 3:
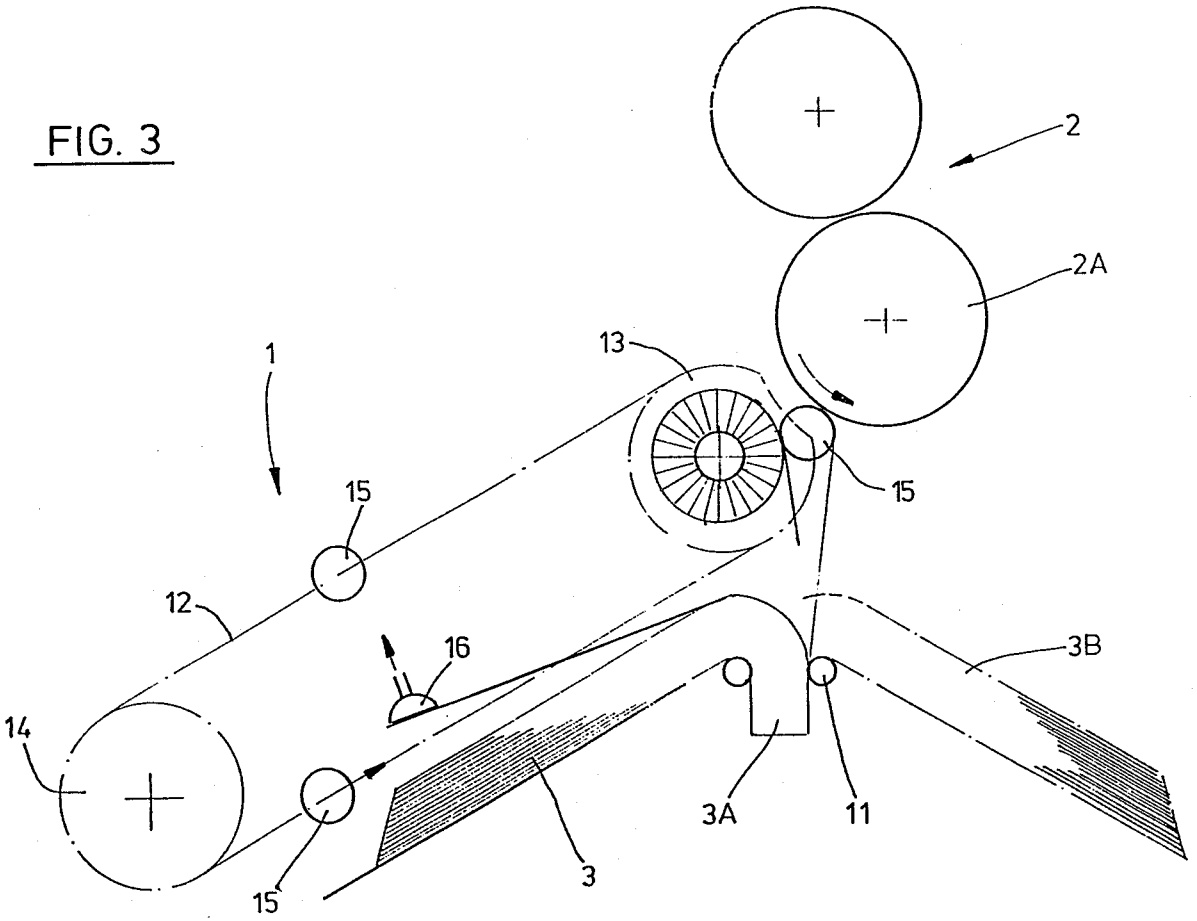
FIG. 3 illustrates the sheet feeder lifting an individual sheet at the same time printing the previous sheet.
Figure 4:
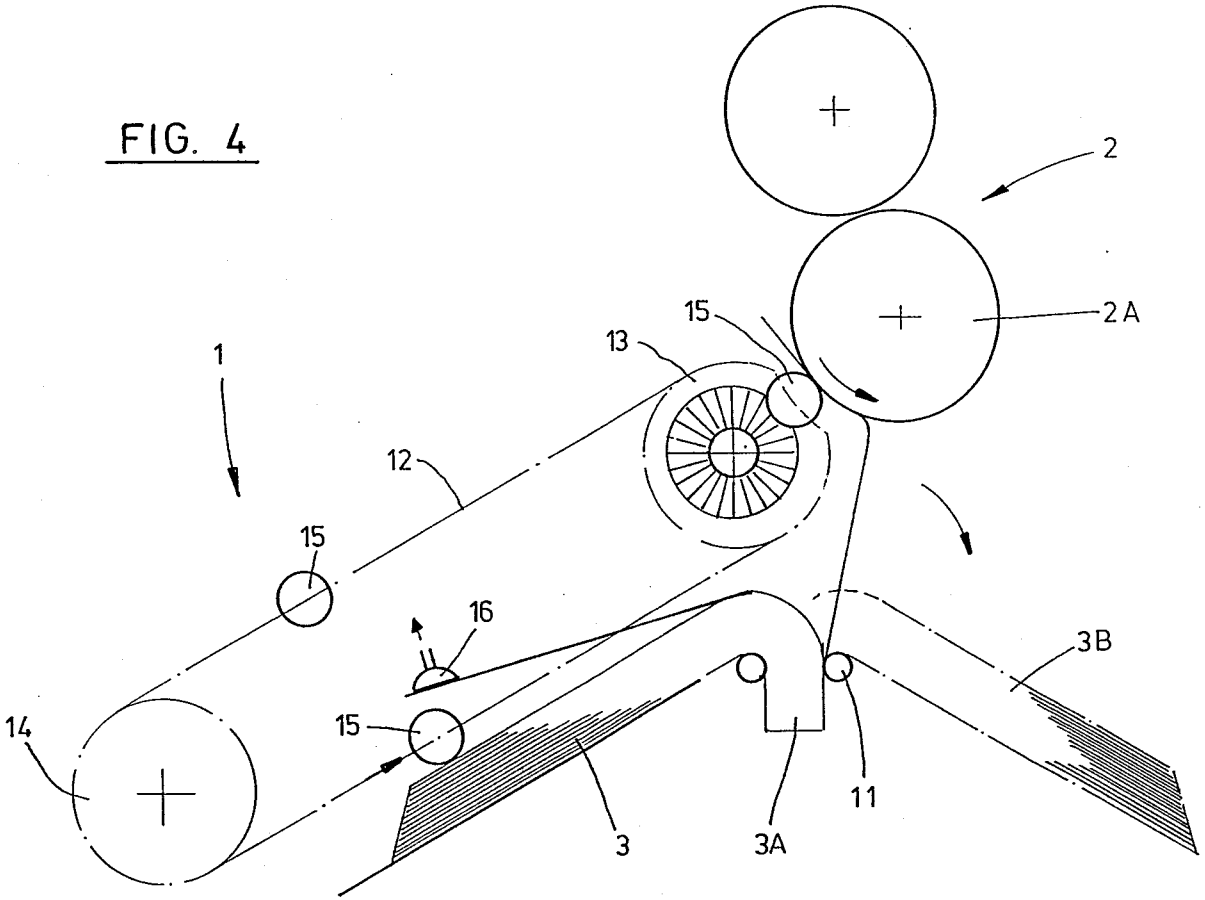
FIG. 4 illustrates how the driving and pressure roller slides under the lifted sheet while at the same time the previous sheet runs from the nip between the impression cylinder and pressure roller and moves into its turned over position.

The mode of operation of the sheet feeder 1 is explained in more detail in FIGS. 2 to 4, which diagrammatically show the individual phases of the operation of the invention, which is briefly described below:

(a) suction gripper 16 in each case is placed on the topmost sheet of stack 3 and is put under partial vacuum (FIG. 2);

(b) suction gripper 16 is lifted from the sheet stack and thus lifts the respective topmost sheet (FIG. 3);

(c) a roller 15 placed on conveyor element 12 of the endless conveyor moves between the completely lifted sheet and the remaining sheet stack (FIG. 4);

(d) the respective roller 15 moves forward under the lifted sheet, which the suction gripper has released in the meantime, and carries the sheet in the direction toward impression cylinder 2A, while suction gripper 16 is again placed on the stack for gripping of the next sheet (FIG. 2);

(e) roller 15 presses the sheet it has gripped on impression cylinder 2A and the printing process begins, in which roller 15 working with the impression cylinder 2A acts as a pressure roller, and meanwhile lifting of the next sheet takes place (FIG. 3);

(f) the printing process proceeds by the just printed sheet running out of the mechanism between the impression cylinder and roller 15 acting as a pressure roller, with the printed sheet, which the impression cylinder 2A rotates in the opposite direction to the rotational movement of the endless conveyor, being automatically moved into turned-over position 3B indicated by the dot-dash line, as indicated by an arrow while at the same time the next roller 15 travels under the next sheet completely lifted in the meantime.

This process is repeated until all the sheets of the stack are printed, after which the stack is replaced and the new stack is put in its starting position shown by solid lines, pointing to the left in the drawings, whereby the printing process is concluded.

I claim:

1. A sheet feeder and a printing device for printing sheets in a stack already bound along a common edge, comprising:

(a) a stack holder for holding the sheet stack along the bound edge, (b) a rotating endless conveyor driven between the sheet stack top and printing device, (c) a lifting element, placed in the area of sheet stack, which is stationary with respect to the rotational movement of the endless conveyor but movable perpendicularly with respect to the sheet stack top for lifting of the respective topmost sheet of the sheet stack, and (d) at least one driving and pressure roller which is rotatably connected to the endless conveyor for sliding under a sheet lifted by the lifting element, and moving the sheet against an impression cylinder supported by said printing device and thereby serving as a pressure roller.

2. The sheet feeder according to claim 1, wherein said driver and pressure roller is guided by a guide means in the vicinity of said impression cylinder, the path of said guide means defining a circular segment parallel to said impression cylinder.

3. The sheet feeder according to claim 1, wherein the lifting element is a suction gripper.

4. The sheet feeder according to claim 1, wherein said impression cylinder of said printing device rotates in the opposite direction with respect to the endless conveyor so that the sheets printed are moved to a turned-over position after being printed.

5. A sheet feeder for use with a printing device for printing sheets in a stack already bound along a common edge, comprising:

(a) a stack holder for holding the sheet stack along the bound edge, (b) a rotating endless conveyor driven between the sheet stack top and printing device, (c) a lifting element, placed in the area of sheet stack, which is stationary with respect to the rotational movement of the endless conveyor but movable perpendicularly with respect to the sheet stack top for lifting of the respective topmost sheet of the sheet stack, and (d) at least one driving roller which is rotatably connected to the endless conveyor for sliding under a sheet lifted by the lifting element and for moving the sheet toward a turned over position, whereby the driving roller and the endless conveyor are adapted for moving the sheet against an impression cylinder of a printing device to thereby serve as a pressure roller.

6. The sheet feeder according to claim 5, but wherein the lifting element is a suction gripper.

* * * * *